US007193192B2

(12) United States Patent
Lamb

(10) Patent No.: US 7,193,192 B2
(45) Date of Patent: Mar. 20, 2007

(54) TEMPERATURE-RESPONSIVE DEVICE

(75) Inventor: Stuart Lamb, Redditch (GB)

(73) Assignee: Ceramaspeed Limited (GB)

( * ) Notice: Subject to any disclaimer, the term of this patent is extended or adjusted under 35 U.S.C. 154(b) by 0 days.

(21) Appl. No.: 10/542,229

(22) PCT Filed: Jan. 16, 2004

(86) PCT No.: PCT/GB2004/000151

§ 371 (c)(1),
(2), (4) Date: Dec. 19, 2005

(87) PCT Pub. No.: WO2004/066678

PCT Pub. Date: Aug. 5, 2004

(65) Prior Publication Data

US 2006/0157473 A1 Jul. 20, 2006

(30) Foreign Application Priority Data

Jan. 18, 2003 (GB) ..... 03011964.0

(51) Int. Cl.
*H05B 3/06* (2006.01)

(52) U.S. Cl. ..... 219/542; 219/448.11; 219/447.1; 219/448.19; 219/505

(58) Field of Classification Search ..... 219/448.11, 219/448.19, 447.1, 460.1, 505, 542
See application file for complete search history.

(56) References Cited

U.S. PATENT DOCUMENTS 4,508,961 A 4/1985 McWilliams
4,845,340 A * 7/1989 Goessler et al. ..... 219/448.19
5,113,170 A * 5/1992 Goessler et al. ..... 337/394
5,420,398 A * 5/1995 Petri et al. ..... 219/505
5,489,764 A * 2/1996 Mannuss et al. ..... 219/448.19
5,893,996 A * 4/1999 Gross et al. ..... 219/447.1
6,229,119 B1 5/2001 Petri et al.

(Continued)

FOREIGN PATENT DOCUMENTS

EP 0810814 3/1999

(Continued)

OTHER PUBLICATIONS

International Search Report Apr. 20, 2004.

*Primary Examiner*—Robin Evans
*Assistant Examiner*—Leonid M. Fastovsky
(74) *Attorney, Agent, or Firm*—Ira S. Dorman

(57) ABSTRACT

A temperature-responsive device (14) is provided for an electric heater (2). The heater (2) is located behind a heatable surface and comprises a dish-like support (6) having therein at least one electric heating element (12) having first and second terminal regions, (12A, 12B). An electrical component (18), having an electrical parameter which changes as a function of temperature, is supported inside the heater (2) by an elongate member (16). The elongate member (16) is secured to the heater (2) and extends at least partially across the heater (2). An electrically insulating carrier member (30) is secured to the elongate member (16) at a location externally of the periphery of the heater (2). The carrier member (30) has first and second side edges (32, 38) at opposite sides of the elongate member (16) and is provided with first and second electrically conductive elements (34, 40) accessible at the opposite side edges (32, 38) for electrical connection to the first and second terminal regions (12A, 12B).

36 Claims, 2 Drawing Sheets

U.S. PATENT DOCUMENTS

Figure 1:
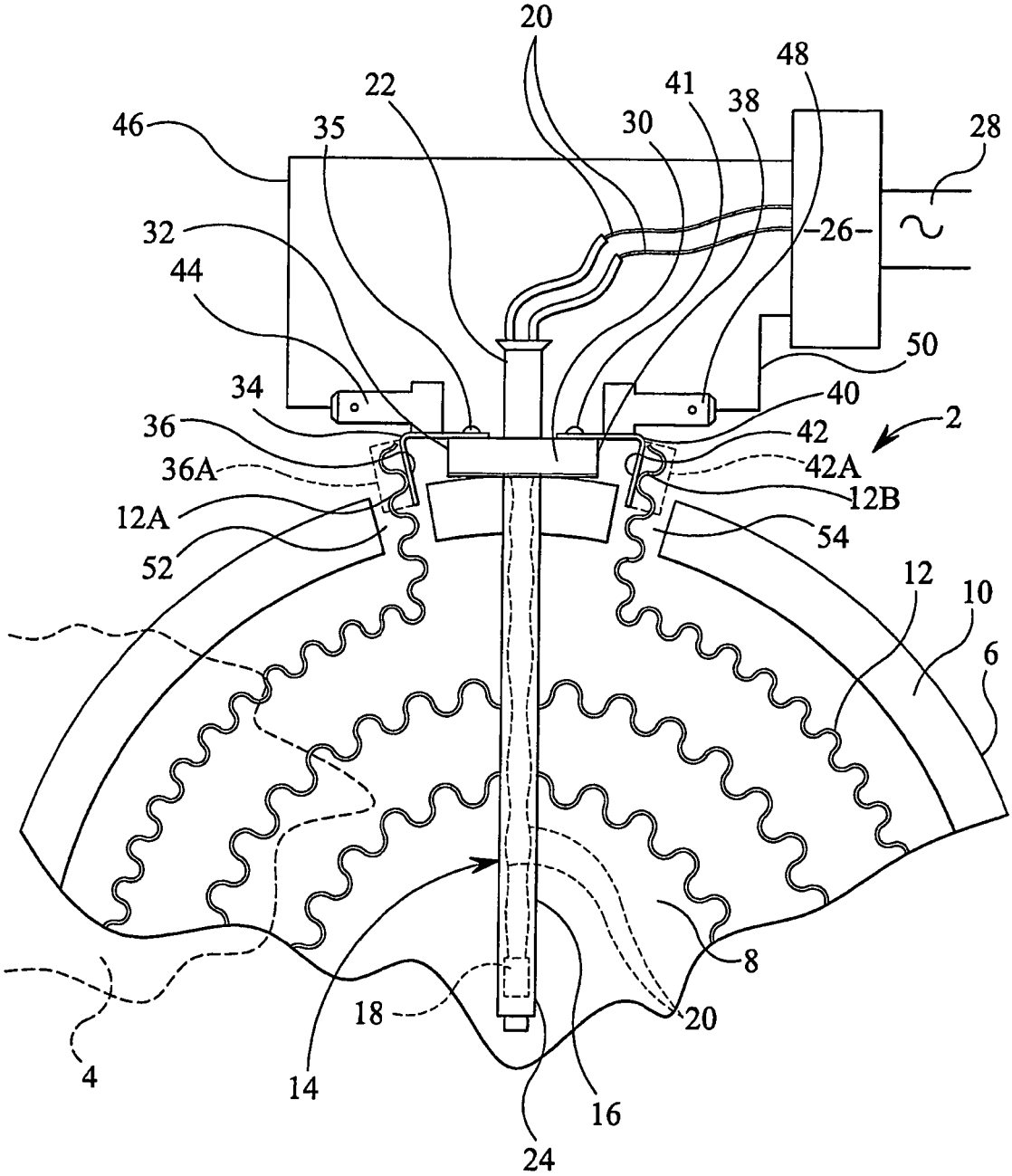

| | | | | |
|---|---|---|---|---|
| 6,376,810 | B2 * | 4/2002 | Higgins | 219/448.11 |
| 6,765,179 | B2 * | 7/2004 | Wilde et al. | 219/448.19 |
| 7,132,626 | B2 * | 11/2006 | Higgins et al. | 219/460.1 |
| 2002/0121510 | A1 | 9/2002 | Petri et al. | |

FOREIGN PATENT DOCUMENTS

| | | |
|---|---|---|
| WO | WO 03003793 | 9/2003 |

* cited by examiner

TEMPERATURE-RESPONSIVE DEVICE

This invention relates to an electric heater provided with a temperature-responsive device, for example an electric heater for use in a cooking appliance, such as a cooking hob having a glass-ceramic cooking surface.

It is well known to provide a temperature-responsive device for controlling operation of an electric heater. Such an electric heater is typically arranged for location behind a surface to be heated, such as a glass-ceramic cooking surface, and generally comprises a dish-like support having therein at least one electric heating element. In particular, the temperature-responsive device comprises an electrical component having an electrical parameter which changes as a function of temperature and which is supported by an elongate member which is arranged to extend at least partly across the heater from a periphery thereof. The electrical component provides an electrical output which changes as a function of temperature, the electrical component being electrically connected to an electronic controller, such as a microprocessor-based controller, to control energising of the electric heater from a power supply.

In particular, the electrical component comprises an electrical resistance temperature detector, such as a platinum resistance temperature detector, whose electrical resistance changes as a function of temperature. The electrical component may be supported inside a tube, such as of metal or ceramic, or on an elongate beam, such as of ceramic material.

It is known to provide a terminal block externally on the dish-like support of the heater. Such terminal block is remote from the temperature-responsive device and is connected inside the heater to terminal regions of the heating element or elements. External leads are arranged from the terminal block to the power supply, suitably by way of the electronic controller.

It is also known to provide direct electrical connection between terminal regions of a heating element and connecting elements on a temperature-limiting device, such connecting elements being accessible in the region of a front face of a switch housing of the temperature-limiting device adjacent to the heater. In this known arrangement, the temperature-limiting device comprises a differentially-expanding rod and tube assembly, which extends at least partly across the heater from the housing and operates one or more switch means located in the housing.

It is an object of the present invention to provide an electrical connection between terminal regions of a heating element and electrical conducting elements on a temperature-responsive device of an electric heater which overcomes or at least ameliorates disadvantages of the above arrangements.

According to the present invention there is provided an electric heater adapted for location behind a surface to be heated and comprising a dish-like support having therein at least one electric heating element having a first terminal region and a second terminal region and a temperature-responsive device, wherein the temperature-responsive device comprises an electrical component having an electrical parameter which changes as a function of temperature and arranged to be supported inside the heater by an elongate member which is adapted to be secured to the heater and to extend at least partially across the heater from a region externally of the periphery thereof, an electrically insulating carrier member being secured to the elongate member at a location externally of the periphery of the heater, the carrier member having a first side edge and a second side edge laterally disposed at opposite sides of the elongate member and provided with a first electrically conductive element and a second electrically conductive element accessible at the opposite side edges of the carrier member for electrical connection to the first and second terminal regions respectively of the at least one electric heating element.

Electrical connection of the first and second electrically conductive elements to the respective first and second terminal regions of the at least one heating element may be by means of direct contact between the electrically conductive elements and the terminal regions.

The first and second terminal regions of the at least one heating element may extend through apertures in the dish-like support for electrical connection to the first and second electrically conductive elements.

The first and second terminal regions of the at least one heating element may be electrically connected to the first and second electrically conductive elements by welding.

At least one of the first and second electrically conductive elements may be provided with a portion selected from a strip-like portion and a flanged portion for securing to at least one of the first and second terminal regions of the at least one heating element.

The strip-like portion may have a plane thereof disposed in any desired orientation from a vertical plane to a horizontal plane.

The flanged portion may have a wall portion with a dependant laterally-directed ledge portion.

At least one of the first and second electrically conductive elements may have the portion extending in a direction towards the heater and at a predetermined angle relative to a rim of the dish-like support.

Alternatively, at least one of the first and second electrically conductive elements may be arranged for electrical connection to a terminal region selected from the respective first and second terminal regions of the at least one heating element by way of at least one electrically conductive link, for example of a form selected from wire and strip form.

The at least one electrically conductive link may extend through apertures in the dish-like support for electrical connection to the first and second electrically conductive elements.

The at least one electrically conductive link may be electrically connected to the first and second electrically conductive elements by welding.

At least one of the first and second electrically conductive elements may be provided with a portion selected from a strip-like portion and a flanged portion for securing to the at least one electrically conductive link.

The strip-like portion may have a plane thereof disposed in any desired orientation from a vertical plane to a horizontal plane.

The flanged portion may have a wall portion with a dependant laterally-directed ledge portion.

At least one of the first and second electrically conductive elements may have the portion extending in a direction towards the heater and at a predetermined angle relative to a rim of the dish-like support.

The first and second electrically conductive elements may extend laterally at the first and second opposite side edges of the carrier member.

The at least one electric heating element may be of corrugated ribbon form supported upstanding on edge in the dish-like support.

At least one of the first and second terminal regions of the at least one electric heating element of corrugated ribbon form may be connected directly to at least one of the first and second electrically conductive elements and have an orientation substantially the same as that of the at least one electric heating element as supported in the dish-like support, or may be twisted through an appropriate angle for connection to at least one of the first and second electrically conductive elements.

The first and second electrically conductive elements may comprise metal, such as stainless steel or nickel-plated steel.

The first and second electrically conductive elements may be provided with means for electrical connection thereof to external lead wires. Such means for electrical connection may comprise terminal members, such as of tab or spade form.

The carrier member may comprise ceramic material.

The electrical component may be provided with electrical leads extending therefrom and emerging from the elongate member at the region of the heater externally of the periphery thereof. Such electrical leads may be adapted to be electrically connected to an electronic controller, such as a microprocessor-based controller, which is adapted to provide controlled electrical connection between a power supply and the first and second electrically conductive elements.

The electrical component may comprise a device whose electrical resistance changes as a function of temperature, and may comprise an electrical resistance temperature detector, such as a platinum resistance temperature detector.

The elongate member may comprise a tube, such as of metal or ceramic, inside which the electrical component is arranged.

Alternatively, the elongate member may comprise a beam, such as of ceramic material, on a surface of which the electrical component is provided.

Figure 2:
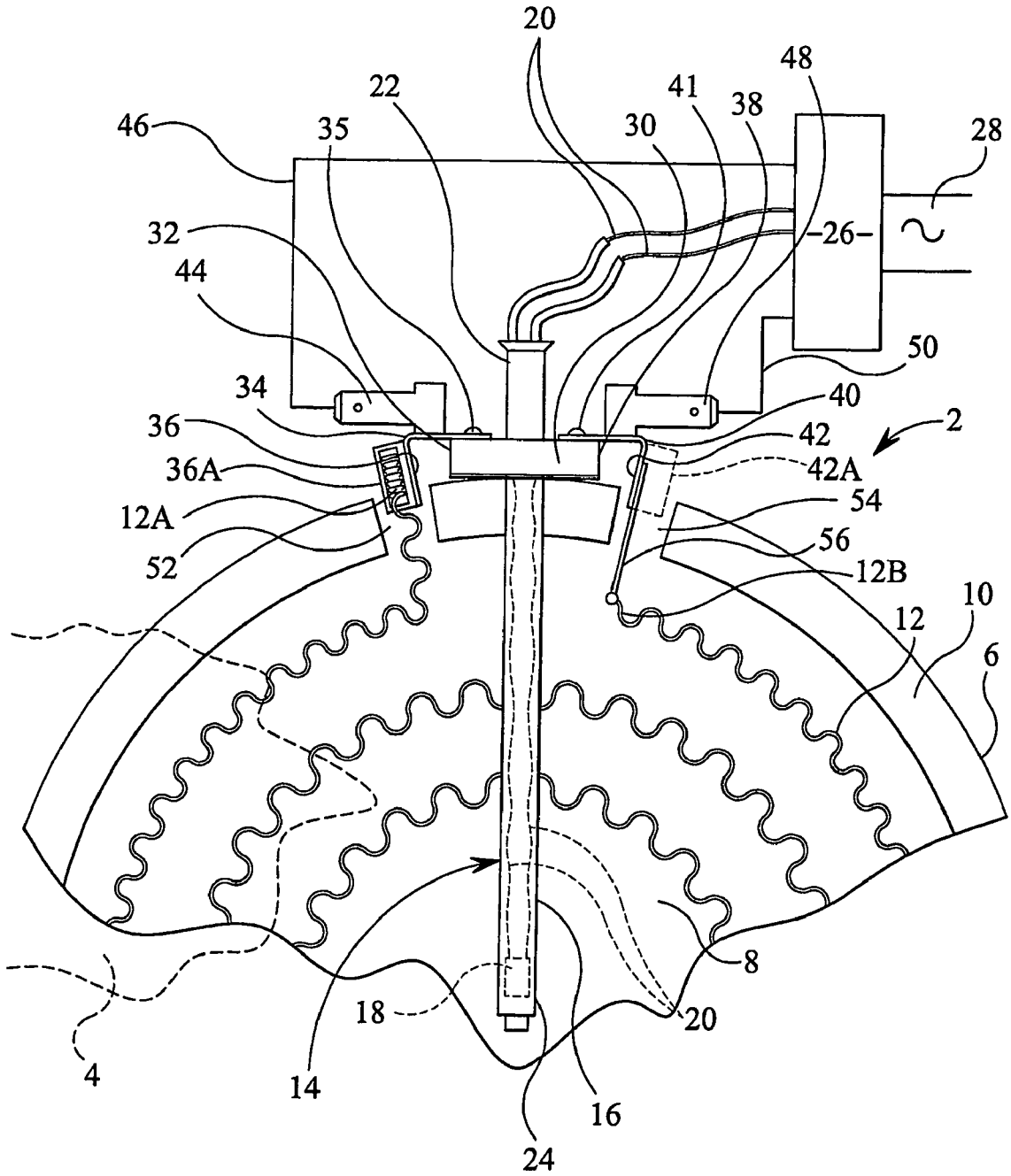

For a better understanding of the present invention and to show more clearly how it may be carried into effect, reference will now be made, by way of example, to the accompanying drawings in which:

FIG. 1 is a plan view of an arrangement of part of an electric heater according to the present invention provided with an embodiment of a temperature-responsive device; and FIG. 2 is a plan view of a modification of the arrangement of FIG. 1.

Referring to FIG. 1, an electric heater 2 is arranged for location beneath a surface 4 to be heated. The surface 4 may be a cooking surface and may comprise glass-ceramic material.

The heater 2 comprises a dish-like support 6, such as of metal, containing a layer 8 of thermal and electrical insulation material, such as microporous thermal and electrical insulation material. A peripheral wall 10 of thermal insulation material is provided in the dish-like support 6 and contacts the underside of the surface 4 to be heated.

At least one radiant electric heating element 12 is arranged inside the dish-like support 6. As shown in FIG. 1, heating element 12 comprises a corrugated metal ribbon arranged upstanding on edge in the dish-like support 6. However, other forms of heating element could be provided.

A temperature-responsive device 14 is provided for the heater 2 and comprises an elongate member 16 which is suitably secured to the heater at the periphery thereof and extends from a region externally of the periphery of the heater, through an aperture in the rim of the dish-like support 6 and the peripheral wall 10, and at least partially across the heater. The elongate member 16 is arranged to overlie and be spaced from the at least one heating element 12.

The elongate member 16 supports an electrical component 18 having an electrical parameter which changes as a function of temperature and which is provided with electrically conducting leads 20 which extend therefrom and emerge from the elongate member 16 at an end 22 thereof which is located externally of the heater 2. The electrical component 18 suitably comprises a device whose electrical resistance changes as a function of temperature and may comprise an electrical resistance temperature detector, such as a platinum resistance temperature detector.

The elongate member 16 may comprise a tube, such as of metal or ceramic, inside which the electrical component 18 is arranged at one end 24 thereof, and with the leads passing along the tube. Alternatively, the elongate member 16 may comprise a beam, such as of ceramic, on an upper surface of which the electrical component 18 is arranged at one end 24 thereof. In this case, the electrical component 18 and/or the portion of the leads extending therefrom along the beam 16, may be of film form, deposited on the surface of the beam 16, although this is not essential.

The leads 20 from the electrical component 18 are arranged to be electrically connected to a microprocessor-based electronic controller 26, which is electrically connected to a power supply 28.

A carrier member 30 of electrically insulating material, such as ceramic, is secured to the elongate member 16 externally of the heater at the end 22 of the elongate member 16. The carrier member 30 is suitably of block form and is suitably provided with an aperture through which the elongate member 16 passes. The carrier member 30 may form an interference fit with the elongate member 16 or may be secured thereto by adhesive or other means.

The carrier member 30 has a first side edge 32 at which laterally extends a first electrically conductive element 34 having a portion 36 extending in a direction towards the heater at a predetermined angle relative to the rim of the dish-like support 6.

The carrier member 30 has a second side edge 38 at which laterally extends a second electrically conductive element 40 having a portion 42 extending in a direction towards the heater at a predetermined angle relative to the rim of the dish-like support 6.

The first electrically conductive element 34 is provided with a terminal member 44, such as of tab or spade form, arranged for electrical connection to an external lead wire 46 provided from the power supply 28 by way of the controller 26. The second electrically conductive element 40 is likewise provided with a terminal member 48, such as of tab or spade form, arranged for electrical connection to an external lead wire 50 provided from the power supply 28 by way of the controller 26.

The first and second electrically conductive elements 34, 40 are suitably secured to the carrier member 30 by means 35, 41, which may comprise rivets. Alternatively, other fastening means such as twist tabs, welding or discrete fasteners such as drive screws of standard screws and nuts may be employed.

The first and second electrically conductive elements 34 and 40 are accessible at the side edges 32, 38 of the carrier member 30 and suitably comprise metal, such as stainless steel or nickel-plated steel. They are suitably of strip form.

The corrugated ribbon heating element 12 has first and second terminal regions 12A and 12B thereof extending through apertures 52, 54 in the peripheral wall 10 and the rim of the dish-like support 6, of the heater 2. If desired, the terminal regions 12A and 12B need not be corrugated. The first terminal region 12A of the heating element 12 is welded directly to the portion 36 of the first electrically conductive element 34 and the second terminal region 12B of the heating element 12 is welded directly to the portion 42 of the second electrically conductive element 40. The first and second electrically conductive elements 34, 40 are readily accessed at the side edges 32, 38 of the carrier member 30 by the jaws of a pincer welding apparatus (not shown), to effect the necessary welding operations.

The portions 36 and 42 of the first and second electrically conductive elements 34, 40 may comprise wall portions and have dependant outwardly-directed ledge portions 36A and 42A respectively, such that the first and second electrically conductive elements 34, 40 have a resultant flanged form. The ledge portions 36A and 42A serve to support the first and second terminal regions 12A, 12B of the heating element 12 during the welding operation and may each be provided with an upstanding lip (not shown) on the outer edge thereof to assist retention of the terminal regions 12A, 12B on the ledge portions 36A, 42A prior to welding. The lips may extend upwardly by about 2 mm and such that they do not inhibit access by the welding apparatus. Alternatively, other means (not shown) may be provided to retain the terminal regions 12A, 12B on the ledge portions 36A, 42A prior to welding.

The portions 36 and 42 of the first and second electrically conductive elements 34, 40 could be of simple strip form, having a plane thereof disposed in any desired orientation from a vertical plane to a horizontal plane.

When the heater 2 is energised for operation, heat is sensed by the electrical component 18 and its electrical parameter, such as electrical resistance, changes as a function of temperature. The change in the electrical parameter is monitored by the controller 26, which operates in known manner to control energising of the at least one heating element 12 from the power supply 28, through the lead wires 46, 50, and provide a desired heating rate and/or temperature limit for the heater.

As shown in FIG. 1, the first and second terminal regions 12A, 12B of the corrugated ribbon heating element 12 have an orientation substantially the same as that of the heating element 12 as supported in the dish-like support 6. If desired, however, the first and/or second terminal region or regions 12A, 12B of the heating element 12 may be twisted through an appropriate angle for connection to the first and/or second electrically conductive elements 34, 40 in a different plane. This is illustrated in FIG. 2, where the first terminal region 12A of the heating element 12 is twisted and welded to the outwardly-directed ledge portion 36A of the portion 36 of the first electrically conductive element 34. The second terminal region 12B of the heating element 12 can be similarly arranged.

Instead of the first and second terminal regions 12A, 12B of the heating element 12 being directly welded to the first and second electrically conductive elements 34, 40, one or more intermediate electrically conductive links, such as of wire or strip form, may be provided connecting the first and/or second terminal regions 12A, 12B of the heating element 12 to the first and/or second electrically conductive elements 34, 40 respectively. This is illustrated in FIG. 2, where the second terminal region 12B of the heating element 12 is welded to one end of a link 56 inside the heater 2. The link 56 passes through aperture 54 in the peripheral wall 10 and the rim of the dish-like support 6 of the heater 2 and is welded at its opposite end to the portion 42, or the portion 42A, of the second electrically conductive element 40. The first terminal region 12A of the heating element 12 can be similarly treated.

The provision of one or more electrically conductive links, such as the link 56, is particularly advantageous when a heating element of lamp form is provided instead of the ribbon heating element 12 and where terminals on an envelope of the lamp cannot be connected directly to the first and second electrically conductive elements 34, 40.

Although specific reference has been made to an electrical component 18 in the form of an electrical resistance temperature detector, such as a platinum resistance temperature detector, the electrical component 18 could comprise any other suitable device having an electrical parameter which changes as a function of temperature. For example, the component 18 could comprise a thermistor or a thermocouple, or a device whose electrical capacitance or inductance appropriately changes as a function of temperature.

It is to be noted that no electrical connections are provided, on the temperature responsive device 14, between the first and second electrically conductive elements 34, 40 on the carrier means 30 and the electrical component 18 supported by the elongate member 16.

The invention claimed is:

1. An electric heater (2) adapted for location behind a surface to be heated and comprising a dish-like support (6) having therein at least one electric heating element (12) having a first terminal region (12A) and a second terminal region (12B) and a temperature-responsive device (14), wherein the temperature-responsive device comprises an electrical component (18) having an electrical parameter which changes as a function of temperature and arranged to be supported inside the heater (2) by an elongate member (16) which is adapted to be secured to the heater (2) and to extend at least partially across the heater (2) from a region externally of the periphery thereof, an electrically insulating carrier member (30) being secured to the elongate member (16) at a location externally of the periphery of the heater (2), the carrier member (30) having a first side edge (32) and a second side edge (38) laterally disposed at opposite sides of the elongate member (16) and provided with a first electrically conductive element (34) and a second electrically conductive element (40) accessible at the opposite side edges (32, 38) of the carrier member (30) for electrical connection to the first and second terminal regions (12A, 12B) respectively of the at least one electric heating element (12).

2. An electric heater as claimed in claim 1, wherein electrical connection of the first and second electrically conductive elements (34, 40) to the respective first and second terminal regions (12A, 12B) of the at least one heating element (12) is by means of direct contact between the electrically conductive elements (34, 40) and the terminal regions (12A, 12B).

3. An electric heater as claimed in claim 1, wherein the first and second terminal regions (12A, 12B) of the at least one heating element (12) extend through apertures in the dish-like support (6) for electrical connection to the first and second electrically conductive elements (34, 40).

4. An electric heater as claimed in claim 1, wherein the first and second terminal regions (12A, 12B) of the at least one heating element (12) are electrically connected to the first and second electrically conductive elements (34, 40) by welding.

5. An electric heater as claimed in claim 1, wherein at least one of the first and second electrically conductive elements (34, 40) is provided with a portion (36, 42) selected from a strip-like portion and a flanged portion for securing to at least one of the first and second terminal regions (12A, 12B) of the at least one heating element (12).

6. An electric heater as claimed in claim 5, wherein the strip-like portion has a plane thereof disposed in any desired orientation from a vertical plane to a horizontal plane.

7. An electric heater as claimed in claim 5, wherein the flanged portion has a wall portion with a dependant laterally-directed ledge portion (36A, 42A).

8. An electric heater as claimed in claim 5, wherein at least one of the first and second electrically conductive elements (34, 40) has the portion (36, 42) extending in a direction towards the heater (2) and at a predetermined angle relative to a rim of the dish-like support (6).

9. An electric heater as claimed in claim 1, wherein at least one of the first and second electrically conductive elements (34, 40) is arranged for electrical connection to a terminal region selected from the respective first and second terminal regions (12A, 12B) of the at least one heating element (12) by way of at least one electrically conductive link (56).

10. An electric heater as claimed in claim 9, wherein the at least one electrically conductive link (56) is of a form selected from wire and strip form.

11. An electric heater as claimed in claim 9, wherein the at least one electrically conductive link (56) extends through apertures in the dish-like support (6) for electrical connection to the first and second electrically conductive elements (34, 40).

12. An electric heater as claimed in claim 9, wherein the at least one electrically conductive link (56) is electrically connected to the first and second electrically conductive elements (34, 40) by welding.

13. An electric heater as claimed in claim 9, wherein at least one of the first and second electrically conductive elements (34, 40) is provided with a portion (36, 42) selected from a strip-like portion and a flanged portion for securing to the at least one electrically conductive link (56).

14. An electric heater as claimed in claim 13, wherein the strip-like portion has a plane thereof disposed in any desired orientation from a vertical plane to a horizontal plane.

15. An electric heater as claimed in claim 13, wherein the flanged portion has a wall portion with a dependant laterally-directed ledge portion (36A, 42A).

16. An electric heater as claimed in claim 9, wherein at least one of the first and second electrically conductive elements (34, 40) has the portion (36, 42) extending in a direction towards the heater (2) and at a predetermined angle relative to a rim of the dish-like support (6).

17. An electric heater as claimed in claim 1, wherein the first and second electrically conductive elements (34, 40) extend laterally at the first and second opposite side edges (32, 38) of the carrier member (30).

18. An electric heater as claimed in claim 1, wherein the at least one electric heating element (12) is of corrugated ribbon form (12) supported upstanding on edge in the dish-like support (6).

19. An electric heater as claimed in claim 18, wherein at least one of the first and second terminal regions (12A, 12B) of the at least one electric heating element (12) of corrugated ribbon form (12) is connected directly to at least one of the first and second electrically conductive elements (34, 40) and has an orientation substantially the same as that of the at least one electric heating element (12) as supported in the dish-like support (6).

20. An electric heater as claimed in claim 18, wherein at least one of the first and second terminal regions (12A, 12B) of the at least one electric heating element (12) of corrugated ribbon form (12) is connected directly to at least one of the first and second electrically conductive elements (34, 40) and is twisted through an appropriate angle for connection to at least one of the first and second electrically conductive elements (34, 40).

21. An electric heater as claimed in claim 1, wherein the first and second electrically conductive elements (34, 40) comprise metal.

22. An electric heater as claimed in claim 21, wherein the metal is selected from stainless steel and nickel-plated steel.

23. An electric heater as claimed in claim 1, wherein the first and second electrically conductive elements (34, 40) are provided with means for electrical connection thereof to external lead wires (50).

24. An electric heater as claimed in claim 23, wherein the means for electrical connection comprises terminal members (44, 48).

25. An electric heater as claimed in claim 24, wherein the terminal members (44, 48) are of a form selected from tab and spade form.

26. An electric heater as claimed in claim 1, wherein the carrier member (30) comprises ceramic material.

27. An electric heater as claimed in claim 1, wherein the electrical component (18) is provided with electrical leads (20) extending therefrom and emerging from the elongate member (16) at the region of the heater (2) externally of the periphery thereof.

28. An electric heater as claimed in claim 27, wherein the electrical leads (20) are adapted to be electrically connected to an electronic controller (26) which is adapted to provide controlled electrical connection between a power supply (28) and the first and second electrically conductive elements (34, 40).

29. An electric heater as claimed in claim 28, wherein the electronic controller (26) is a microprocessor-based controller (26).

30. An electric heater as claimed in claim 1, wherein the electrical component (18) comprises a device whose electrical resistance changes as a function of temperature.

31. An electric heater as claimed in claim 1, wherein the electrical component (18) comprises an electrical resistance temperature detector.

32. An electric heater as claimed in claim 31, wherein the electrical resistance temperature detector is a platinum resistance temperature detector.

33. An electric heater as claimed in claim 1, wherein the elongate member (16) comprises a tube inside which the electrical component (18) is arranged.

34. An electric heater as claimed in claim 33, wherein the tube is of a material selected from metal and ceramic.

35. An electric heater as claimed in claim 1, wherein the elongate member (16) comprises a beam on a surface of which the electrical component (18) is provided.

36. An electric heater as claimed in claim 35, wherein the beam is of ceramic material.

* * * * *